United States Patent [19]

Mellini

[11] Patent Number: 4,881,893

[45] Date of Patent: Nov. 21, 1989

[54] METALLIC LANTERN MANTLE

[76] Inventor: John D. Mellini, 304 Fall St., Seneca Falls, N.Y. 13148

[21] Appl. No.: 290,647

[22] Filed: Dec. 27, 1988

[51] Int. Cl.[4] ..... F21H 1/00

[52] U.S. Cl. ..... 431/100; 431/109; 431/113

[58] Field of Search ..... 431/100, 101, 109, 110, 431/113, 111; 362/453, 454, 443, 34, 84; 126/249; 248/301, 316.5, 316.6

[56] References Cited

U.S. PATENT DOCUMENTS 354,977 12/1886 Galopin et al. ..... 431/109
793,646 7/1905 Farkas ..... 431/100 X
898,881 9/1908 Hanna ..... 431/109 X
1,237,780 8/1917 Hicks ..... 431/110

FOREIGN PATENT DOCUMENTS 563466 6/1958 France ..... 431/100

*Primary Examiner*—Randall L. Green
*Attorney, Agent, or Firm*—Leon Gilden

[57] ABSTRACT

A metallic lantern mantle is set forth for use particularly in combination with camp-type lanterns utilizing a propane or gasoline-type fuel. The mantle is of a gauge to increase intermal pressure within the mantle volume and enhance luminescent qualities of the mantle during use. A serrated clamp adjustably accommodates an associated fuel outlet in the aforenoted lamp.

5 Claims, 1 Drawing Sheet

METALLIC LANTERN MANTLE

BACKGROUND OF THE INVENTION

1. Field of the Invention

The field of invention relates to lantern mantles, and more particularly pertains to a new and improved metallic lantern mantle wherein the same provides a rigid, yet durable, structure to accommodate vibration and impact.

2. Description of the Prior Art

The use of lantern mantles is notoriously well known in the prior art. Mantles of the prior art have been primarily constructed of various fabrics or ceramics that have provided adequate luminescent qualities, but have heretofore incorporated fragile structures that have been subject to breakage with the attendant inconvenience of the loss of the lantern in a camping situation. Examples of prior art mantles have includes U.S. Pat. No. 1,123,869 to Hadley utilizing an aluminum mantle which may be carbonized prior to application. The mantle of the Hadley patent fails to provide the desired adjustable clamp as set forth by the instant invention and further fails to utilize desired mesh size in use of the metallic lantern incorporating construction of stainless steels and the like to effect illumination with mesh sizes of two to five meshes per centimeter.

U.S. Pat. No. 2,715,825 to Zimmerman sets forth a lantern mantle with a fabric draw-string utilized to secure the mantle to a lantern and is formed of a woven or knitted fabric subject to destruction during vibration in use.

U.S. Pat. No. 3,324,687 to Swinyar sets forth a ceramic-type mantle with predetermined porosity throughout the mantle wherein the mantle of Swinyer is subject to the frangible nature of such material and subjects the mantle to premature destruction during use.

U.S. Pat. No. 3,649,157 to Klauer sets forth a mantle formed of textile and utilizing a conventional thread for securing the mantle to a lantern lacking the positive grasping arrangement of the instant invention.

U.S. Pat. No. 4,533,317 to Addision sets forth a mantle for use with fuel burning lanterns wherein the mantle of the Addison patent utilizes a woven rayon mantle sack utilizing a mixture of metal hydroxides convertible to metal oxides upon firing of the mantle impregnated within the fabric. The patent fails to provide the durability of organization and grasping ability of the mantle of the instant invention.

It may be appreciated that there is a continuing need for a new and improved metallic lantern mantle wherein the same addresses both the problems of durability as well as positive clamping to an associated lantern, and in this respect the present invention substantially fulfills this need.

SUMMARY OF THE INVENTION

In view of the foregoing disadvantages inherent in the known types of metallic lantern mantles now present in the prior art, the present invention provides a metallic lantern mantle wherein the same may be readily and adaptably secured to a variety of combustible gas supply outlets within lanterns and is further readily resistant to destruction during impact and vibration of the lantern during use. As such, the general purpose of the present invention, which will be described subsequently in greater detail, is to provide a new and improved metallic lantern mantle which has all the advantages of the prior art lantern mantles and none of the disadvantages.

To attain this, the present invention comprises a metallic lantern mantle of a relatively fine woven mesh of elongate ellipsoidal cross-sectional configuration utilizing a plurality of radiating polar ribs extending about the length of the mantle for reinforcing the mantle during impact. An adjustable clamp utilizing internal serrations for grasping of the metallic mesh is utilized with exterior teeth engageable with a latch pin to secure the mantle to a lantern.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construtions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved metallic lantern mantle which has all the advantages of the prior art lantern mantles and none of the disadvantages.

It is another object of the present invention to provide a new and improved metallic lantern mantle which may be easily and efficiently manufactured and marketed.

It is a further object of the present invention to provide a new and improved metallic lantern mantle which is of a durable and reliable construction.

An even further object of the present invention is to provide a new and improved metallic lantern mantle which is susceptible of a low cost of manufacture with regard to both materials and labor, and which accordingly is then susceptible of low prices of sale to the consuming public, thereby making such metallic lantern mantle economically available to the buying public.

Still yet another object of the present invention is to provide a new and improved metallic lantern mantle which provides in the apparatuses and methods of the prior art some of the advantages thereof, while simultaneously overcoming some of the disadvantages normally associated therewith.

Still another object of the present invention is to provide a new and improved metallic lantern mantle provided with an adjustable engagement strap for securing the mantle to a variety of gas supply pipes within lanterns and further utilizes reinforcing ribs extending longitudinally of the mantle joining at the distal polar end for reinforcing the mantle and maintaining its configuration during use.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
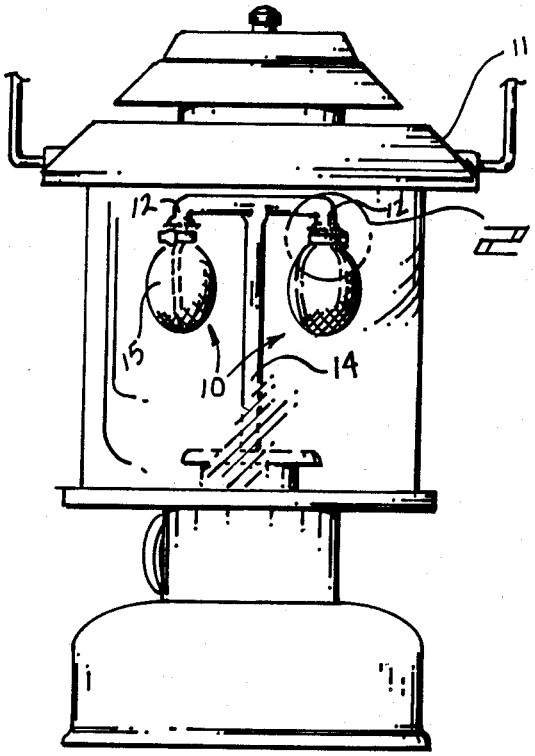
FIG. 1 is an isometric illustration of the instant invention positioned within a conventional lantern.
Figure 3:
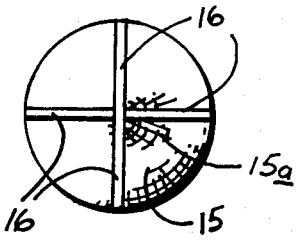
FIG. 3 is an orthographic bottom view of the instant invention.
Figure 2:
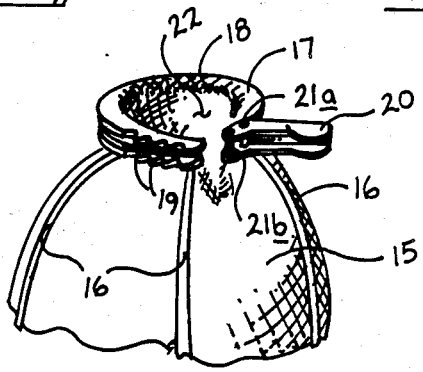
FIG. 2 is an isometric illustration, somewhat expanded, of the section 2 as indicated in FIG. 2.

With reference now to the drawings, and in particular to FIGS. 1 to 3 thereof, a new and improved metallic lantern mantle embodying the principles and concepts of the present invention and generally designated by the reference numeral 10 will be described.

More specifically, it will be noted that the metallic lantern mantle 10 of the instant invention is of a ellipsoidal revolution defined by an ellipsoid with its major elongate vertically oriented axis equal to approximately one and one-quarter inches with a minor orthogonally directed axis of approximately one inch. The ellipsoidal configuration is tailored to the flame length and propagation during combustion of the flammable gas utilized by the associated lantern and desirably, the mesh is of a relatively fine mesh of substantially two to five meshes per centimeter to enhance back pressure within the volume of the mantle and enhance the luminescent qualities of the gas during its combustion in the mantle. The configuration of the mantle is critical in that a mantle of a length defined by the major axis of the ellipsoidal configuration will lack the stability and integrity of configuration, as opposed to the dimensional relationship of the instant invention. Preferably, the mesh of the mantle of the instant invention is of a twenty to thirty-five gauge stainless steel-type wire per "U.S. Steel wire" standards.

The lantern mantle 10 of the instant invention is securable about outlet pipes 12 of a typical lantern 11, as utilized as in a camping environment. The lantern 11 is formed with a fuel reservoir 13 and a conventional fuel delivery pipe 14 extending upwardly and directed to the fuel outlet pipes 12.

The mantle 15 is formed of a mesh of a first diameter gauge, as noted above, with a plurality of reinforcing ribs 16 extending longitudinally of the polar center 15*a* located at the lowermost edge of the sack-like mantle 10 of a second diameter greater than the first diameter to effect reinforcing of the mantle 15 to maintain its integrity and configuration when subject to impact.

A securement ring 17 of a typical twenty-four gauge U.S. Standard Sheet Metal is formed about the upper inlet 22 of the mantle 15 and may be either welded to the mantle inlet periphery 22 or secured to the securement ring 17 wherein the securement ring 17 is formed with inwardly directed serrations 18 for securement of the mantle to the ring 17. The securement ring 17 is formed with plural parallel spaced rows of engagement teeth 19 proximate an exterior terminal end of the ring 17 with the other terminal end of the ring 17 formed with a latch 20 formed with a latch bar 21 adjacent and parallel to a pivot bar 21*a* wherein the latch bar 21 is engageable with one of the engagement teeth 19 for securement of the mantle 15 to an outlet pipe 12, as illustrated in FIG. 1.

As noted, the mantle 15 is made of steel wire of twenty to thirty-five gauge thickness with thirty gauge preferred with the reinforcing rib 16 formed of a greater gauge, desirably of at least of five gauges thicker than that utilized in formation of the mantle body member. For example if a thirty gauge mantle mesh 15 is utilized, a twenty-five gauge wire is utilized for the reinforcing ribs 16.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Thereore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by LETTERS PATENT of the United States is as follows:

1. A metallic mesh mantle for use with a portable fuel burning lantern wherein said lantern includes a gas outlet pipe for deliverance of said fuel, said mantle comprising, a sack-shaped mantle formed with an open end, said mantle formed of an elongate configuration and of a fine metallic mesh, and a metallic clamping means secured about the open end of the mantle for adjustable securement about the outlet pipe of said lantern wherein said metallic clamping means includes a securement ring wih a first terminal end formed with outwardly projecting parallel rows of engagement teeth arranged to receive and engage a second terminal end including a latch. and wherein said sack-shaped mantle is defined by an ellipsoidal surface of revolution including a major elongate vertical axis and a minor horizontal axis, and wherein the major axis is of a length equal to 1.25 inches, and said minor axis is of a length equal to 1 inch, and wherein the mantle is formed of stainless steel wire of a gauge within a range of twenty to thirty-five gauge.

2. A metallic mesh mantle as set forth in claim 1 wherein said latch includes a latch bar engageable with said engagement teeth and wherein said latch bar is adjacent to and spaced from a parallel pivot bar to enable said latch to be securebly mounted upon said outlet pipe.

3. A metallic mesh mantle as set forth in claim 2 wherein said securement ring includes inwardly projecting serrations for securement of said mantle to the securement ring.

4. A metallic mesh mantle as set forth in claim 3 further including a plurality of reinforcing ribs formed about the periphery of the mantle and of a wire gauge greater than that of the gauge of the wire mesh forming said mantle.

5. A metallic mesh mantle as set forth in claim 4 wherein four enforcing ribs are formed on said mantle and wherein said reinforcing ribs are joined at the polar lowermost end of the mantle.

* * * * *